US007699027B2

(12) United States Patent
Ma

(10) Patent No.: US 7,699,027 B2
(45) Date of Patent: Apr. 20, 2010

(54) PORTABLE GENERATOR

(76) Inventor: Yunfeng Ma, No. 2 Jishui Road, Jingiao Development Zone, Mudu Town, Wuzhong District, Suzhou (CN)

( * ) Notice: Subject to any disclaimer, the term of this patent is extended or adjusted under 35 U.S.C. 154(b) by 90 days.

(21) Appl. No.: 11/840,425

(22) Filed: Aug. 17, 2007

(65) Prior Publication Data

US 2009/0045684 A1 Feb. 19, 2009

(51) Int. Cl.
*F02B 63/04* (2006.01)

(52) U.S. Cl. ..... 123/3; 290/1 B

(58) Field of Classification Search ..... 123/2, 123/195 C, 198 E, 3; 290/1 A, 1 B, 1 R; 322/1; 310/51
See application file for complete search history.

(56) References Cited

U.S. PATENT DOCUMENTS

| | | | | | |
|---|---|---|---|---|---|
| 3,849,883 | A | * | 11/1974 | Kolorz | 30/381 |
| 4,411,071 | A | * | 10/1983 | Takahashi et al. | 30/381 |
| 4,595,841 | A | * | 6/1986 | Yaguchi | 290/1 A |
| 4,647,835 | A | | 3/1987 | Fujikawa et al. | 322/1 |
| 4,827,147 | A | | 5/1989 | Mitzushima | 290/1 |
| D335,862 | S | | 5/1993 | Kusunoki | D13/116 |
| 6,091,160 | A | | 7/2000 | Kouchi et al. | 290/1 |
| 6,119,636 | A | | 9/2000 | Fan | 123/2 |
| 6,362,533 | B1 | * | 3/2002 | Morohoshi et al. | 290/1 A |
| 6,378,468 | B1 | * | 4/2002 | Kouchi et al. | 123/41.56 |
| 6,637,399 | B2 | * | 10/2003 | Sato et al. | 123/196 R |
| 6,661,107 | B2 | * | 12/2003 | Higuchi et al. | 290/1 A |
| D509,795 | S | | 9/2005 | Buck | D13/116 |
| 2002/0191417 | A1 | | 12/2002 | Suzuki et al. | 363/15 |
| 2005/0046191 | A1 | | 3/2005 | Cole et al. | 290/1 |
| 2008/0088136 | A1 | * | 4/2008 | Ma et al. | 290/1 R |

* cited by examiner

*Primary Examiner*—M. McMahon
(74) *Attorney, Agent, or Firm*—Woodcock Washburn LLP

(57) ABSTRACT

A portable generator, comprising a housing, a handle provided on the housing, and a generator set fixed in the housing; the handle is fixed at the lower part to a link span in the housing; a cylinder head cover of the generator set is provided with an installation slice extending toward both ends; the installation slice is sheathed with a shock-absorbing sleeve and fixed and connected to the link span; and the generator set is connected at the bottom with the housing through a shock-absorbing mat. The generator improves shock-absorption effect, and prolongs service life of the product; it is simple in structure and convenient for maintenance; and it cancels the cover body, which reduces weight and is advantageous to dissipate heat.

5 Claims, 3 Drawing Sheets

PORTABLE GENERATOR

FIELD OF THE INVENTION

The present invention relates to a portable generator.

BACKGROUND OF THE INVENTION

In the prior art, a portable generator comprises a generator set composed of an engine and a generator, and the generator set is placed inside a casing with a handle, so as to make it convenient for customers to carry and use outdoors. There are two kinds of structure for the portable generators currently available on the market: One is that the generator set is fixed inside one cover body, which is fixed and connected at the upper part and the lower part to the upper part and the bottom of the casing, respectively; the other is that the generator set is fixed inside the casing through a support. Although these two kinds of structure are good in soundproof effect, cooling effect and overall rigidity, they have such shortcomings as complicated structure, bothersome maintenance and increased weight, and especially violent vibration during usage.

SUMMARY OF THE INVENTION

A purpose of the present invention is to provide a portable generator, which is simple in structure, convenient for maintenance, lighter in weight, and better in shock-absorption effect as well.

A technical solution of the present invention is as follows: A portable generator, comprising a housing, a handle provided on the housing, and a generator set fixed in the housing; the handle is fixed at the lower part to a link span in the housing; a cylinder head cover of the generator set is provided with an installation slice extending toward both ends; the installation slice is sheathed with a shock-absorbing sleeve and fixed and connected to the link span; and the generator set is connected at the bottom with the housing through a shock-absorbing mat.

A further technical solution of the present invention is as follows: A portable generator, comprising a housing, a handle provided on the housing, and a generator set fixed in the housing; the handle is fixed at the lower part to a link span in the housing; a cylinder head cover of the generator set is provided with an installation slice extending toward both ends; the installation slice is sheathed with a shock-absorbing sleeve and fixed and connected to the link span; the generator set is connected at the bottom with the housing through a shock-absorbing mat; the shock-absorbing sleeve is provided on a side with a slot, into which is one end of the installation slice inserted; the installation slice and the shock-absorbing sleeve are provided with a connecting hole; the shock-absorbing sleeve is provided on the underside with a concave pressing block, which is fixed with a nut; the link span and the installation slice are provided through them with a bolt, which together with the nut fixes and connects the installation slice to the link span in a screwing manner; and the pressing block is provided on the upper surface with a bulge, corresponding to which on the bottom surface is the shock-absorbing sleeve provided with a groove.

A more detailed technical solution of the present invention is as follows: A portable generator, comprising a housing, a handle provided on the housing, and a generator set fixed in the housing; the handle is fixed at the lower part to a link span in the housing; a cylinder head cover of the generator set is provided with an installation slice extending toward both ends; the installation slice is sheathed with a shock-absorbing sleeve and fixed and connected to the link span; the generator set is connected at the bottom with the housing through a shock-absorbing mat; the shock-absorbing sleeve is provided on a side with a slot, into which is one end of the installation slice inserted; the installation slice and the shock-absorbing sleeve are provided with a connecting hole; the shock-absorbing sleeve is provided on the underside with a concave pressing block, which is fixed with a nut; the link span and the installation slice are provided through them with a bolt, which together with the nut fixes and connects the installation slice to the link span in a screwing manner; the pressing block is provided on the upper surface with a bulge, corresponding to which on the bottom surface is the shock-absorbing sleeve provided with a groove; the generator set is provided at the bottom with a base plate; the shock-absorbing mat is provided with an upper bolt extending upward to be connected with the base plate and provided with a lower bolt extending downward to be connected with the housing; the housing is provided at the bottom with shock-absorbing feet, which are provided with female thread; and the lower bolt is fixed and connected to the shock-absorbing feet through the bottom of the housing.

The present invention has the following advantages:

1. The present invention fixes the generator set to the link span and the casing through the shock-absorbing sleeve, the shock-absorbing mat and the shock-absorbing feet, which is better in shock-absorption effect and can prolong service life of the generator.

2. The present invention is simpler in structure, and more convenient for handling and maintenance.

3. The generator set of the present invention is fixed inside the housing through the link span and the base plate, which is advantageous to heat dissipation of the generator set and reduces the overall weight.

The present invention will be further described below according to drawings and embodiments.

DETAILED DESCRIPTION OF ILLUSTRATIVE EMBODIMENTS

Figure 1:
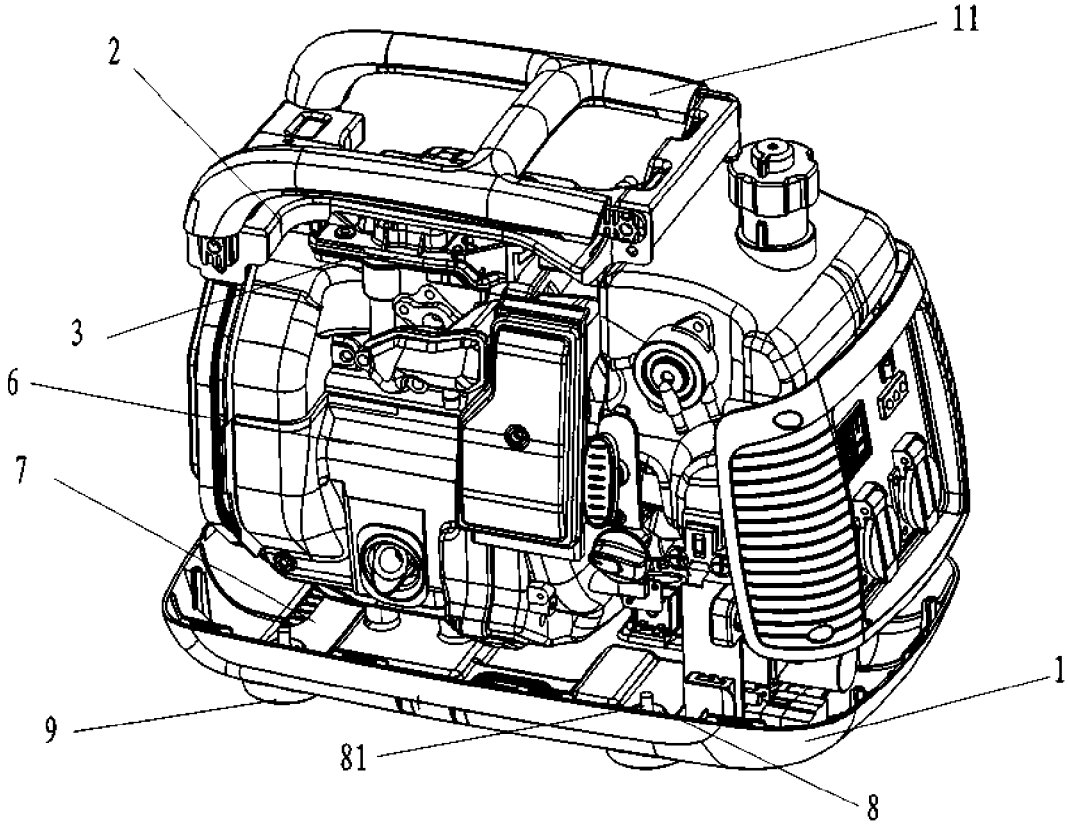
FIG. 1 is a schematic drawing of the structure of an embodiment the present invention.
Figure 2:
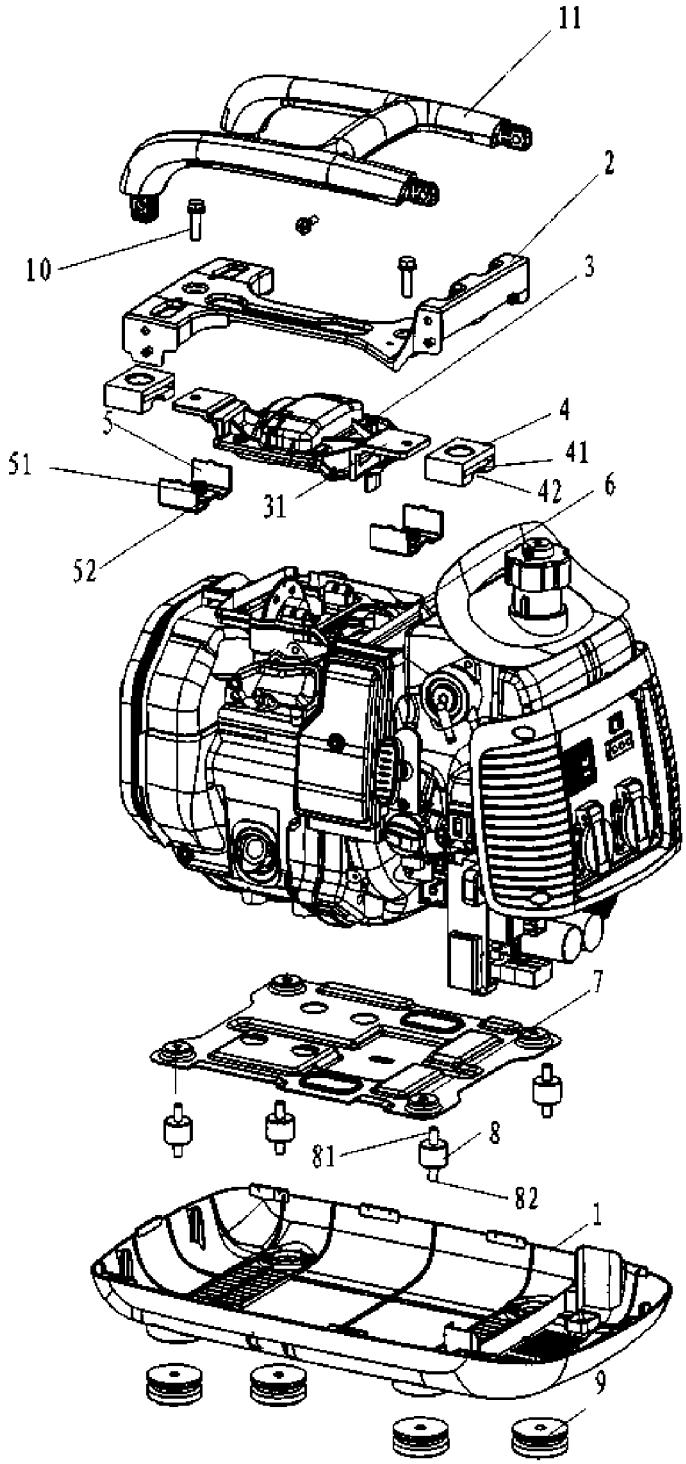
FIG. 2 is an assembly drawing of an embodiment of the present invention.
Figure 3:
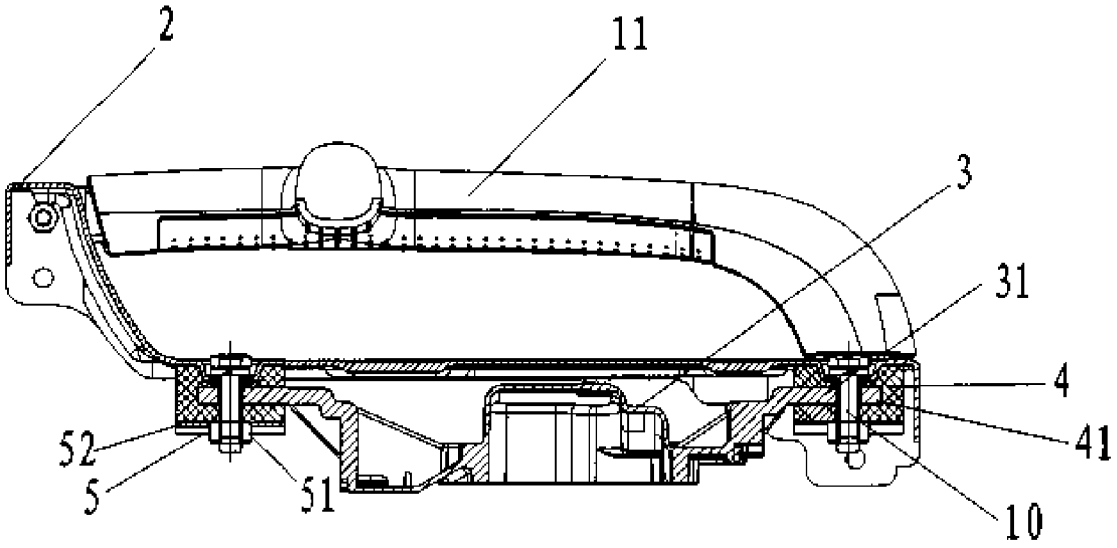
FIG. 3 is a schematic drawing of the connection structure of the handle, the link span and the cylinder head cover.

As shown in FIG. 1, FIG. 2 and FIG. 3, a portable generator, comprising a housing 1, a handle 11 provided on the housing 1, and a generator set 6 fixed in the housing 1; the handle 11 is fixed at the lower part to a link span 2 in the housing 1; the generator set 6 is provided at the top with a cylinder head cover 3, which is provided with an installation slice 31 extending toward both ends; the installation slice 31 is sheathed with a shock-absorbing sleeve 4, which is provided on a side with a slot 41, into which is the installation slice 31 inserted; the installation slice 31 and the shock-absorbing sleeve 4 are provided with a connecting hole; the shock-absorbing sleeve 4 is provided on the underside with a concave pressing block 5, which is provided on the upper surface with a bulge 52, which is fixed with a nut 51; the shock-absorbing sleeve 4 is provided on the bottom surface corresponding to the bulge 52 with a groove 42, which is used to prevent the shock-absorbing sleeve 4 from gliding relative to the pressing block 5; and the link span 2 and the installation slice 3 are provided through them with a bolt 10, which together with the nut 51 fixes and connects the installation slice 31 to the link span 2 in a screwing manner.

The generator set 6 is connected at the bottom with the housing 1 through a shock-absorbing mat 8, and fixed at the bottom to a base plate 7; the shake-absorbing mat 8 is provided with an upper bolt 81 extending upward to be connected with the base plate 7 and provided with a lower bolt 82 extending downward; the housing 1 is provided at the bottom with shock-absorbing feet 9, which are provided with female thread; and the lower bolt 82 is fixed and connected to the shock-absorbing feet 9 through the bottom of the housing 1.

The embodiment of the present invention fixes the generator set 6 to the link span 2 and the housing 1 through the shock-absorbing sleeve 4, the shock-absorbing mat 8 and the shock-absorbing feet 9, which is better in shock-absorption effect and can prolong service life of the generator; the present invention is simpler in structure, and more convenient for handling and maintenance; and the present invention cancels the left and right cover bodies, which is advantageous to heat dissipation of the generator set and reduces the overall weight.

What is claimed:

1. A portable generator comprising a housing, a handle, a base plate, a generator set; a cylinder head and cylinder head cover at the top of the generator set, wherein the handle is fixed at each end of its lower part to a link span, which lies horizontally between the handle and the cylinder head cover, wherein the cylinder head cover lies horizontally between the cylinder head and the link span, wherein an installation slice consisting of two ends projecting horizontally from the cylinder head, wherein each end of the installation slice is sheathed with a shock-absorbing sleeve and fixed and connected to the link span, wherein one sleeve lies below one end of the handle, and the other sleeve lies below the other end of the handle, wherein the generator set is connected at the bottom with the housing through a base plate extending horizontally below the generator set, and shock-absorbing mats, which are provided with an upper bolt extending upward to be connected with the base plate and provided with a lower bolt extending downward to be connected with the housing.

2. The portable generator according to claim 1, wherein the shock-absorbing sleeve is provided on a side with a slot, into which is one end of the installation slice inserted.

3. The portable generator according to claim 1, wherein the installation slice and the shock-absorbing sleeve are provided with a connecting hole, the shock-absorbing sleeve is provided on the underside with a concave pressing block, which is fixed with a nut, and the link span and the installation slice are provided through them with a bolt, which together with the nut fixes and connects the installation slice to the link span in a screwing manner.

4. The portable generator according to claim 3, wherein the pressing block is provided on the upper surface with a bulge, corresponding to which on the bottom surface is the shock-absorbing sleeve provided with a groove.

5. The portable generator according to claim 1, wherein the housing is provided at the bottom with shock-absorbing feet, where each foot is provided with female thread, and each of the lower bolts is fixed and connected to each of the shock-absorbing feet through the bottom of the housing.

* * * * *